US005678922A

United States Patent [19]

Robertson

[11] Patent Number: 5,678,922

[45] Date of Patent: Oct. 21, 1997

[54] LIGHTING FIXTURE AND ANODIZED METALLIC LOUVER SYSTEM THEREFOR

[75] Inventor: Roger Kevin Robertson, Joplin, Mo.

[73] Assignee: H. E. Williams, Inc., Carthage, Mo.

[21] Appl. No.: 515,562

[22] Filed: Aug. 16, 1995

[51] Int. Cl.[6] ..... F21V 17/02

[52] U.S. Cl. ..... 362/290; 362/342; 362/354

[58] Field of Search ..... 362/290, 291, 362/292, 342, 354

[56] References Cited

U.S. PATENT DOCUMENTS

| | | | |
|---|---|---|---|
| 2,971,083 | 2/1961 | Phillips et al. | 362/342 |
| 3,124,310 | 3/1964 | Lipscomb | 362/342 |
| 4,268,897 | 5/1981 | Schierwagen et al. | 362/342 |
| 4,272,804 | 6/1981 | Blum | 362/354 |

FOREIGN PATENT DOCUMENTS

| | | | |
|---|---|---|---|
| 02262207 | 10/1990 | Japan | 362/290 |

*Primary Examiner*—Alfred Basichas
*Attorney, Agent, or Firm*—Beirne, Maynard & Parsons, L.L.P.

[57] ABSTRACT

An electric lighting fixture for mounting relative to a ceiling is disclosed. An enhanced light deflecting louver system is also disclosed in which the louvers provide enhanced light deflection.

12 Claims, 6 Drawing Sheets

LIGHTING FIXTURE AND ANODIZED METALLIC LOUVER SYSTEM THEREFOR

BACKGROUND OF THE INVENTION

1. Field of the Invention

The invention relates to electric lighting fixtures mountable within a ceiling and a louver system therefor.

2. Brief Description of the Prior Art

Many commercial and residential buildings have lighting fixtures which are mounted over the area to be lit, such as an office, work station, workshop, storage area or the like. Typically, but not necessarily, such lighting fixtures incorporate one or more fluorescent, incandescent, or other bulbs or devices for generating or emitting rays of light. Such bulbs are mountable within a housing therefor which is placed into, through, or in proximity with a ceiling, such that the intent is to provide maximum light deflection downwardly, vertically and horizontally away from the light fixture. Louver systems for such devices are typically made of an extruded plastic or, alternatively, a configured metallic sheet of metal, such as aluminum. Such metal may be expected to have applied thereon prior to the louver manufacturing procedures, an anodized protectant which also acts as a polish for the surface of the metal to further enhance reflectivity. Unlike extruded plastic louver systems, louver systems made of such metallic material can be expected to form cracks or other surface defects during manufacture. These defects will, in turn, reduce maximum reflectivity of the louver. A typical prior art metallic louvers which are made from a single piece of metal which has a first end horizontally extending to a point which begins to define a side portion which tapers to a lower or distal end which is "u"-shaped with a companion tapered surface extending back to the top and terminates in another horizontal member directed toward the first horizontal member, but not connected thereto. An opening is provided between such two horizontal members which permits light rays from the fluorescent or other bulb or source to penetrate into an open interior and to be captured therein. Such prior art louver is somewhat like a "bobbie pin" which a lady might use in forming a hair style, or the like.

Such prior art metallic louvers have now been found to be deficient for at least four reasons. First, the opening through the upper or dorsal end of the louver allows light rays to enter into and be captured within the louver. To the extent that the light rays are received therein, such light rays are not available for maximum reflection from and away from the lighting fixture. Secondly, because the dorsal end of such louvers is in horizontal alignment with most of the interior of the lighting fixture housing, light deflection off of the surface of such horizontally disposed end is directed back toward the lighting fixture itself. Thirdly, such prior art metallic louvers result in a "u"-shaped distal end because the taper of the sides is not overlaid. Not only is this aesthetically displeasing, but the prior art "u"-shaped distal end enhances the area of the opening interior of the louver, and enhances obstruction of useable light by reducing maximum curvature of the side members by the amount of open area between the tapered side members in an amount equal to the open interior area within the "u"-shaped end. Fourthly, the prior art metallic louver "u"-shaped end results in surface imperfections, resulting from bending or flexing of the metal, such that additional machining and manufacturing steps are required to abate such surface imperfections.

The present invention is directed to reducing such deficiencies in prior art anodized metallic louvers.

SUMMARY OF THE INVENTION

The present invention is directed to providing a lighting fixture which may be mounted relative to a ceiling. The fixture may be mounted within the ceiling, or slightly above or below it. For example, the lighting fixture may be placed somewhat below the ceiling and be mounted relative to the ceiling by the use of chains or lines extending lowerly of the ceiling to the lighting fixture housing. Alternatively, the lighting fixture may be mounted through the ceiling in known manner. The lighting fixture comprises a lighting fixture housing having means within the housing for receipt of an electrical light generating element. The light generating element typically will be one or a plurality of fluorescent light members, but may also be one or more incandescent light bulbs, and other known or equivalent means of generating or providing electrical light.

Within the light fixture may be found a light directing anodized metallic sheet louver system for placement through the light fixture to provide deflection of the light rays from the bulb or other means. Although the preferred metallic louver may be made of an aluminum-containing material, other like or similar metallic materials also may be utilized. The metallic louver will be provided in a form which anodizes the surface of the sheet to provide a fine polish-like film onto the metal for additional light reflectivity enhancement.

A series of louver fins are provided for use with the lighting fixture. The fins and louver system may be manufactured as separate elements to be finally installed by interengagement and known fashion at the site of or prior to installation of the lighting fixture. Alternatively, the fins may be interengaged to form the louver system and shipped interiorally of the lighting fixture housing such that the louver system is a component part of the lighting fixture and the fluorescent or other light generating bulb. Typically, the fluorescent light or other bulb will be inserted into the lighting fixture housing after installation thereof relative to the ceiling and the louver system installed relative to the lighting fixture thereafter.

The fins forming the louver system include a horizontally enlarged dorsal end member which has face portions directable toward the light fixture housing. The face portions extend to vertically and lowerly projecting tapered side members, with each of the side members having a maximum width. Each of the side members are joined at a point of juncture and terminate at a distal end point having a width no greater than the maximum width of both of the tapered side members.

In a preferred form, the fins have the horizontally enlarged dorsal end face extending completely across the dorsal end of the fin to thereby fully enclose the interior of the fin, thus completely eliminating the entry of light rays into the interior of the fin from the top of the fin. The horizontally enlarged dorsal end face may be convex or may be angled outwardly of and away from the interior of the fin.

The fin for the louver system may be provided with a distal end point which is essentially ninety degrees relative to the tapered side members at the point of juncture to thereby provide maximum reflectivity and aesthetic appeal of the louver fin at the point of juncture of the side members.

DESCRIPTION OF THE PREFERRED EMBODIMENTS

Figure 1A:
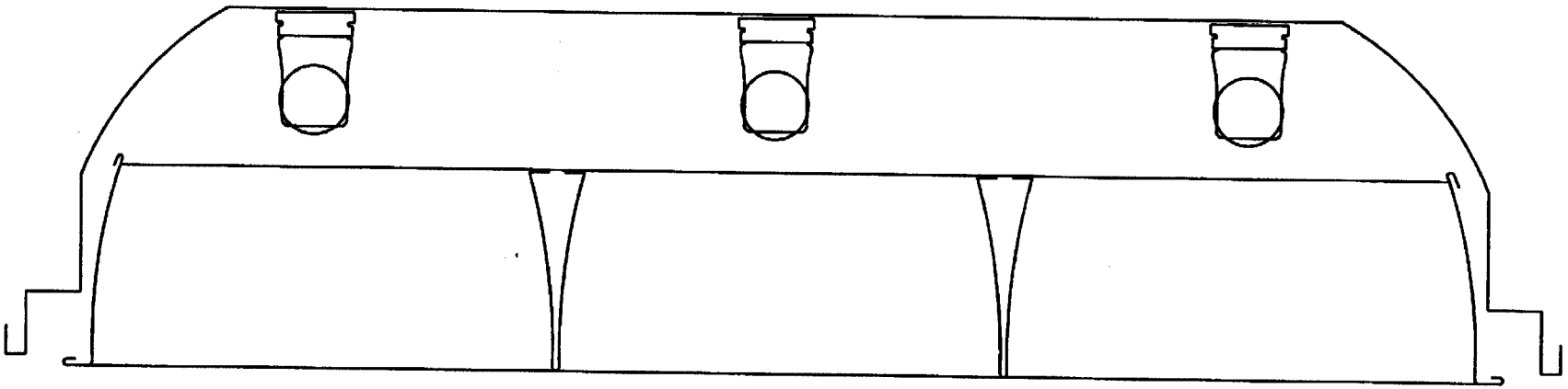
FIG. 1A PRIOR ART
FIG. 1A is a vertical cross-sectional view of prior art fins forming a louver system installed relative to a light fixture housing including a fluorescent bulb.
Figure 1B:
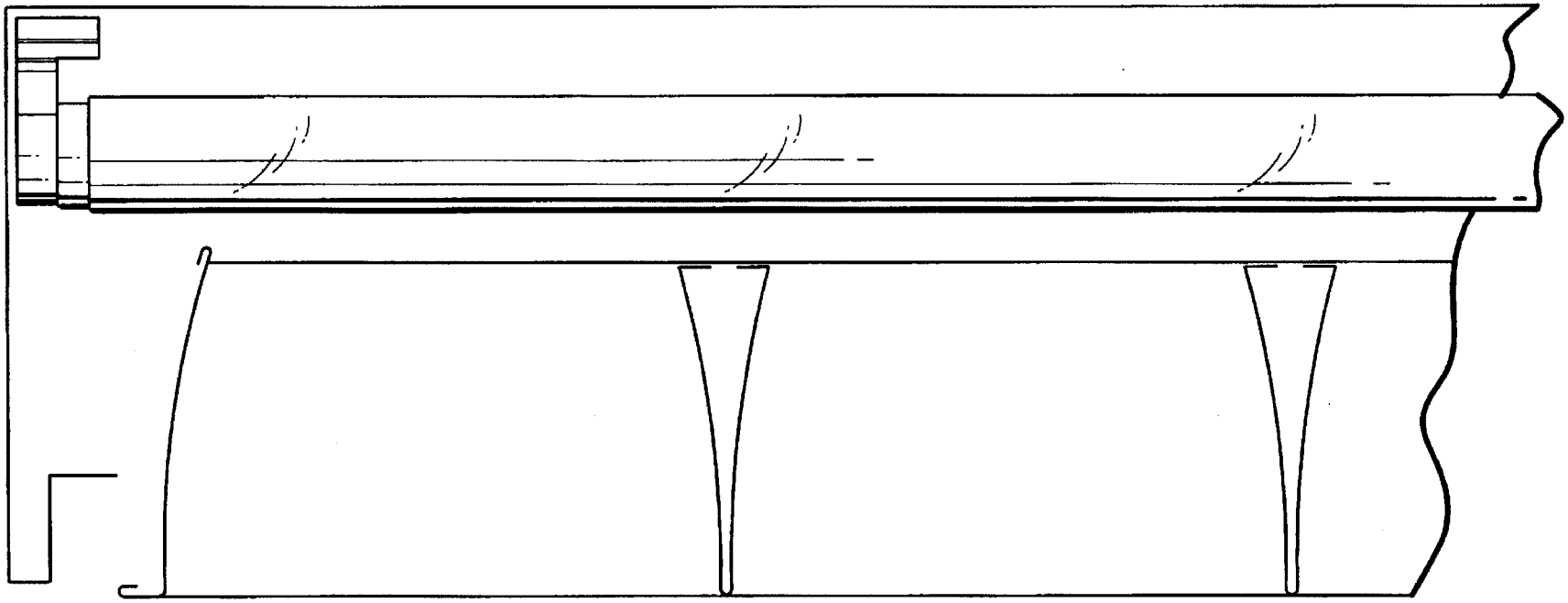
FIG. 1B PRIOR ART
FIG. 1B is a view similar to that shown in FIG. 1A, but in horizontal plane.
Figure 2A:
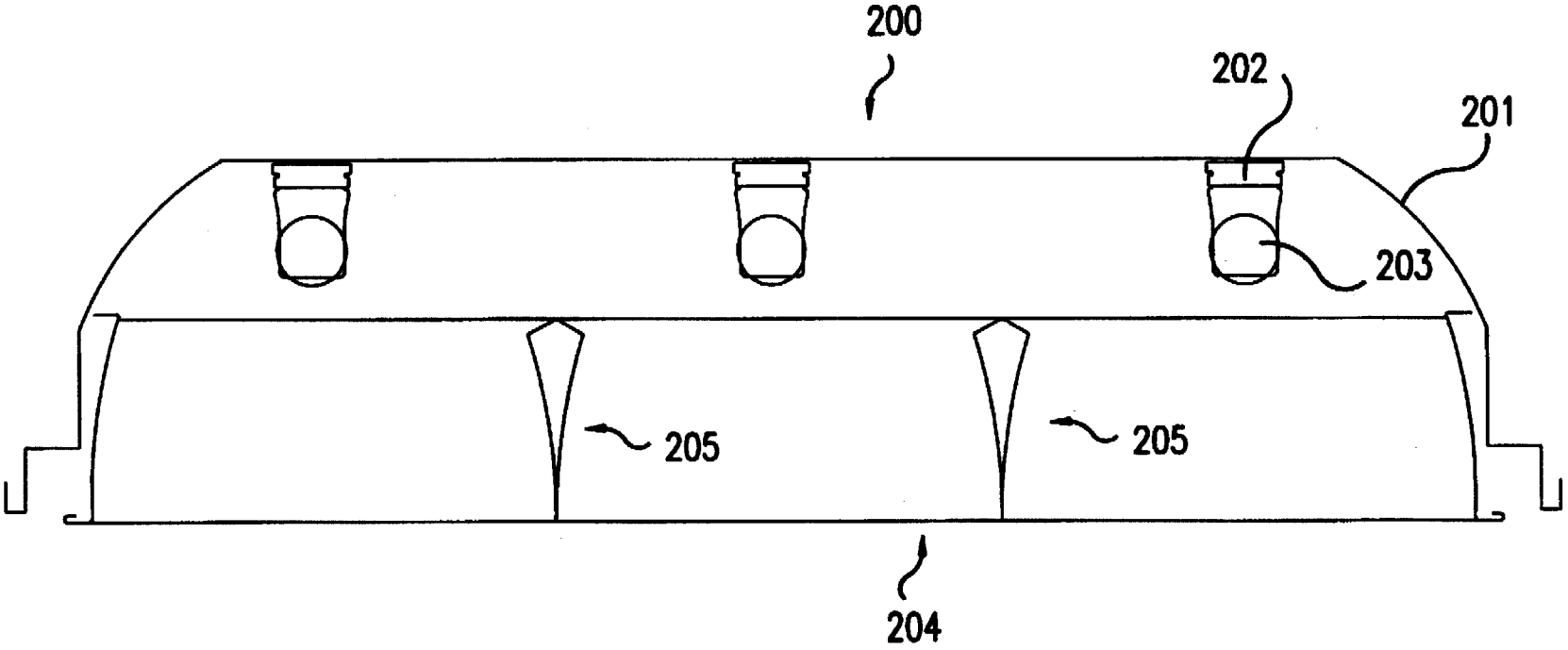
FIG. 2A is a vertical view similar to that shown in FIG. 1A, illustrating the fin and louver system of the present invention.
Figure 2B:
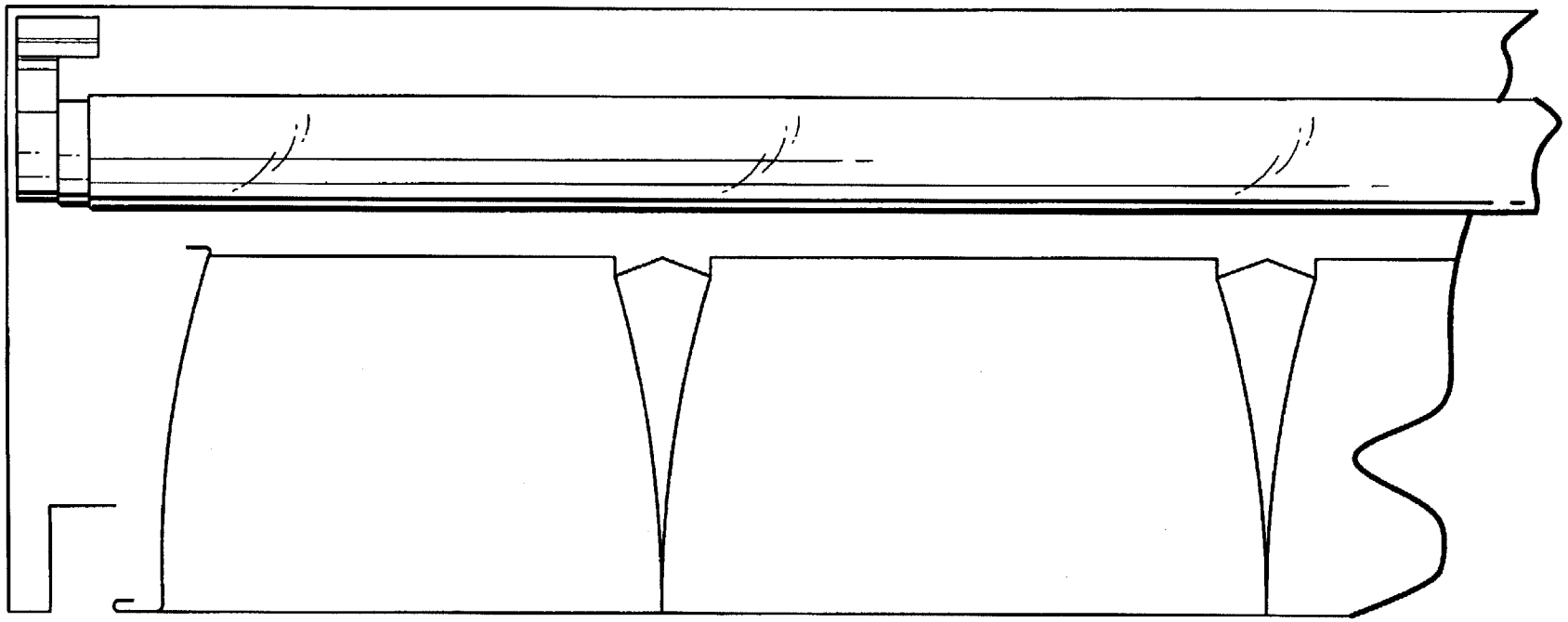
FIG. 2B is a view similar to that of FIG. 2A, but shown in horizontal plane.

Now referring to FIGS. 2A and 2B, a lighting fixture 200 includes a lighter fixture housing 201 having interiorally affixed thereto a series of lighting receptacles 202 for receipt of a light generating element, 203, preferably a fluorescent light bulb. The light bulbs incorporated for use into the present invention are not, per se, a part of the invention itself.

Figure 3:
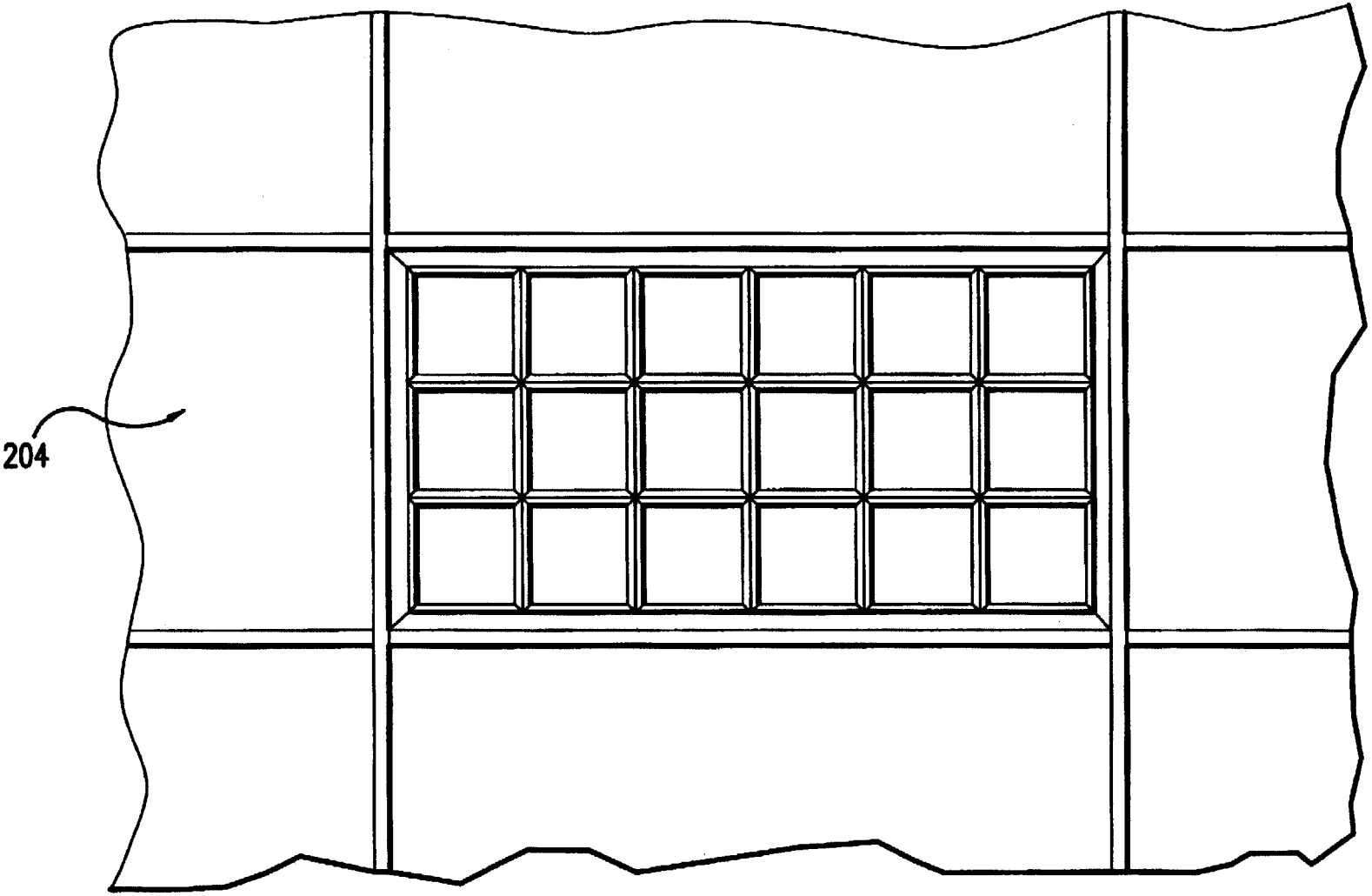
FIG. 3 is a plainer view, looking upwardly, of the louver system of the present invention installed relative to a ceiling.

A louver system 204 is formed by interengaged louver fins 205. The interengagement of one fin with another is accomplished in conventional fashion such as by tabs, vertical grooves and the like. The particular interengagement means will be readily appreciated by those skilled in the art in view of the disclosure and drawings herein. The louver system 204 may be installed relative to the lighting fixture 200 such as in or relative to a ceiling (FIG. 3).

Figure 5:
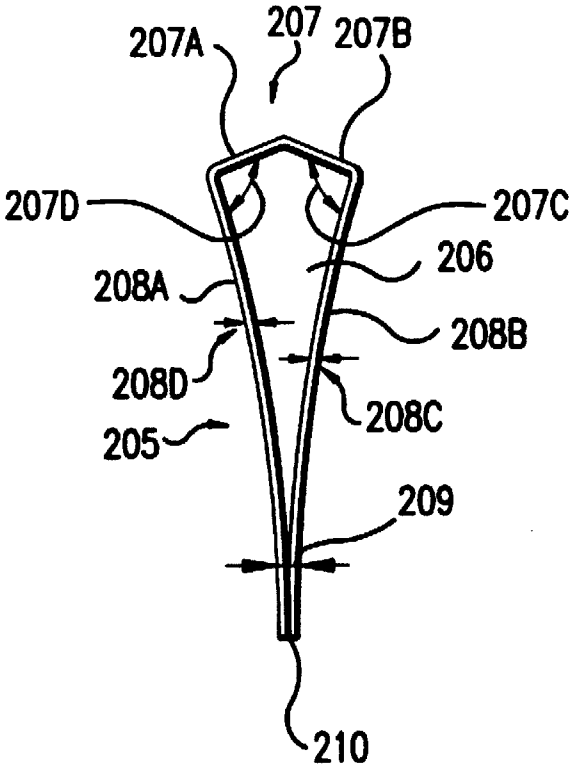
FIG. 5 is a view similar to that of FIG. 4 illustrating the fin of the present invention.
Figure 4:
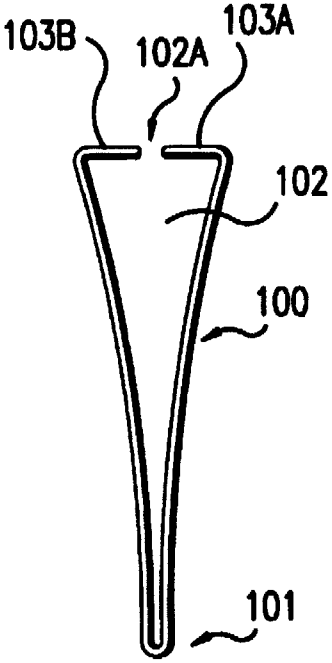
FIG.4 PRIOR ART
FIG. 4 is an enlarged cross-sectional view of a prior art louver fin.

Reference now will be made to FIGS. 4 and 5. First, with respect to FIG. 4, a prior art louver 100 is shown having a u-shaped distal end 101 and an open interior 102. An opening 102A defined by the disjuncture of horizontal top element members 103A and 103B permits light rays to be captured in the open interior 102 resulting in such light rays not being available for maximum reflection from the lighting fixture.

Turning now to FIG. 5, the louver fins 205 are provided with a closed interior area 206 resulting from the dorsal end 207 of the fin 205 being completely closed to eliminate the opening, as in prior art fin FIG. 4, at 102A. The louver fin 205 provides angled face members 207A and 207B to be joined or, most preferably, to result from the manufacturing of the louver fin 205 from one piece of anodized metallic sheet where the ends thereof are at the distal end point 210 and not at the dorsal end 207. The angle 207C and the complimentary angle 207D need not be the same, but each should not be less than about 65°, nor more than about 145°.

Each of the face members 207A and 207B extend downwardly from the dorsal end 207 to form complimentary inwardly tapered side members 208A and 208B each of the members 208A, 208B having a maximum width 208C and 208D. The tapered side members 208A and 208B continue to a point of juncture 209 where the interior surfaces of the tapered members 208A and 208B touch. Preferably, the point of juncture 209 will result not only from the interior sides of the tapered side members 208A and 208B touching one another, but such "touching" is provided by approximately exact overlay of the members 208A and 208B relative to one another such that the maximum width 208C plus the maximum width 208D will equal the width of the point of juncture 209.

The point of juncture 209 may be, or may not be, the distal end point 210, as the side members 208A and 208B defined as the point of juncture 209 may extend distally, somewhat, to the distal end point 210. Alternatively, if no extension is desired, the point of juncture 209 may also define the distal end point 210. The distal end point 210 is essentially 90° relative to the tapered side members 208A and 208B at the point of juncture 209. The distal end point 210 formation will result in square corners with clean surfaces requiring little, if any, manufacturing steps thereafter directed at correction of surface imperfections, resulting in a reduction of time and cost in manufacturing over that required for prior art fins, such as that shown in FIG. 4.

Photometric tests are performed to allow a lighting practitioner to predict the amount of illumination that will be present in a given space or area. The Illumination Engineering Society of North America has published the practices by which these tests are to be performed.

The two basic type of photometry are relative and absolute. In absolute photometry, the actual lamp lumens produced by the equipment at the time of test are used for the calibration of the photometer. These lumen values can vary from lamp to lamp and from test to test with the same lamps. In relative photometry, the rated lumens, those initial lamp lumen values published by the lamp manufacturer, are used for the calibration.

Relative photometry allows a direct comparison between the same type fixtures produced by different manufacturers. There are several basics in any photometric procedure. New lamps must be seasoned for at least 125 hours before they are used. In the case of fluorescent lamps, they should be uniform in output about their diameter by +/−2%. The voltage supplied to the fixture during test should be constant and regulated to +/−2%. The temperature around the fixture during the test and lamps during calibration should be 77 degrees F.+/−2.5 degrees. At the same time, the air velocity shall be less than 30 fpm (feet per minute). The same ballast and lamps must be used for calibration as well as test. The sensing element (light cell) must be at least 5 times the maximum dimension of the fixture away from the fixture. In the case of a 2×4 fixture the cell distance is at least 22.4 feet. The light output of the fixture or lamps must be stable and constant for a least 15 minutes before proceeding with a test or calibration. Finally, the fixture should be in its normal burning position during the test. If the test conditions are followed closely, the photometric test will fall within the acceptable 2.5% repeatability and accuracy.

In the tests, a percentage of the total light from the lamps that is released into the room space as useable light is the efficiency of the lamp and louver system. The remainder of the light is lost and/or absorbed by the fixture, including the louver system.

In accordance with the test description set forth above, the fixture of the present invention was compared with that of a typical prior art louver system to determine light efficiency. Each louver system and fixture incorporated three 32 watt T8 fluorescent lamps in a 2×4 recessed luminaire with white body with a 3" deep 18-cell semi-spec louver. After testing, a lighting efficiency of the device of the prior art was found to be 73.8%. The test was repeated, substituting the louver system of the prior art with that of the present invention. All testing procedures and standards were repeated. In the test incorporating the louver system of the present invention, the lighting efficiency was found to be 76.7%, which is equal to a 4% improvement over that incorporating the prior art louver device, as typified in the prior art Figs. herein.

Figure 6:
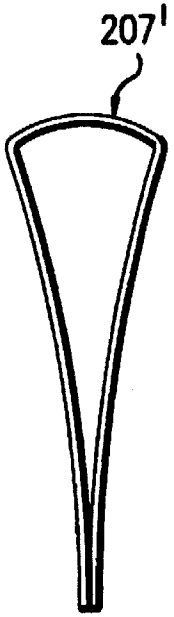
FIG. 6 is a view similar to that of FIG. 5, but showing a convex dorsal end of the fin of the present invention.

As shown in FIG. 6, the horizontally enlarged dorsal end face 207 may be configured as conveyed, such as convex surface 207'.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A lighting fixture for mounting relative to a ceiling, comprising:

(a) a lighting fixture housing;

(b) means within said housing for receipt of an electrical light generating element; and (c) a light directing anodized metallic sheet louver system for placement through the light fixture housing and comprising a series of louver fins having an interior area, each of said fins including a horizontally enlarged dorsal end member having face portions directed toward said light fixture housing and extending to vertically and downwardly projecting tapered side members each having a maximum width, each of said side members joining at a point of juncture to terminate at a distal end point having a width no greater than the maximum width of both of the tapered side members.

2. The lighting fixture of claim 1 wherein the horizontally enlarged dorsal end face extends completely across the dorsal end of the fin to thereby fully enclose the interior of the fin.

3. The lighting fixture of claim 1 or claim 2 wherein the horizontally enlarged dorsal end face is convex.

4. The lighting fixture of claim 1 or claim 2 wherein the horizontally enlarged dorsal end face is angled outwardly of and away from the interior of the fin.

5. The lighting fixture of claim 1 wherein the distal end point is not convex at the point of juncture.

6. The lighting fixture of claim 1 wherein the distal end point is essentially ninety degrees relative to the tapered side members at the point of juncture.

7. A light-directing anodized metallic sheet louver system for placement through a lighting fixture housing, said system comprising a series of louver fins having an interior area, each of said fins including a horizontally enlarged dorsal end member having face portions directable toward said light fixture housing and extending to vertically and downwardly projecting tapered side members, each side member having a maximum width, each of said side members joining at a point of juncture to terminate at a distal end point having a width at said point no greater than the maximum width of both of the tapered side members.

8. The louver system of claim 7 wherein the horizontally enlarged dorsal end face extends completely across the dorsal end of the fin to thereby fully enclose the interior of the fin.

9. The louver system of claim 7 or claim 8 wherein the horizontally enlarged dorsal end face is convex.

10. The louver system of claim 7 or claim 8 wherein the horizontally enlarged dorsal end face is angled outwardly of and away from the interior of the fin.

11. The louver system of claim 7 wherein the distal end point is not convex at the point of juncture.

12. The louver system of claim 7 wherein the distal end point is essentially ninety degrees relative to the tapered side members at the point of juncture.

* * * * *